US007442119B2

(12) United States Patent
Fluhrer

(10) Patent No.: US 7,442,119 B2
(45) Date of Patent: Oct. 28, 2008

(54) VENTILATION DEVICE, PARTICULARLY AN EXHAUST HOOD WITH AIR FLOW CONTROL MEANS

(75) Inventor: Henry Fluhrer, Sternenfels (DE)

(73) Assignee: E.G.O. Elektro-Geratebau GmbH, Oberderingen (DE)

( * ) Notice: Subject to any disclaimer, the term of this patent is extended or adjusted under 35 U.S.C. 154(b) by 0 days.

(21) Appl. No.: 11/736,978

(22) Filed: Apr. 18, 2007

(65) Prior Publication Data

US 2007/0184771 A1 Aug. 9, 2007

Related U.S. Application Data

(63) Continuation of application No. PCT/EP2005/011296, filed on Oct. 20, 2005.

(30) Foreign Application Priority Data

Oct. 20, 2004 (DE) ..... 10 2004 052 201
Mar. 30, 2005 (DE) ..... 10 2005 015 754

(51) Int. Cl.
*F24C 15/20* (2006.01)
*B08B 15/02* (2006.01)

(52) U.S. Cl. ..... 454/67; 454/256; 126/299 D; 126/299 R

(58) Field of Classification Search ..... 454/67, 454/121, 256; 356/439; 126/299 D, 299 R
See application file for complete search history.

(56) References Cited

U.S. PATENT DOCUMENTS 3,723,746 A 3/1973 Lawson et al.
3,743,430 A * 7/1973 Riggs ..... 356/435
3,809,480 A * 5/1974 Somerville et al. ..... 356/338
3,932,137 A * 1/1976 Culpepper, Jr. ..... 422/108

(Continued)

FOREIGN PATENT DOCUMENTS

DE 4418409 8/1995

(Continued)

OTHER PUBLICATIONS

German Search Report for German Application No. 10 2004 052 201.4.

(Continued)

*Primary Examiner*—Steven B. McAllister
*Assistant Examiner*—Patrick F. O'Reilly, III
(74) *Attorney, Agent, or Firm*—Alston & Bird LLP

(57) ABSTRACT

Disclosed is an exhaust hood (10) comprising a drive unit (20) for generating an air flow, a control device or control circuit for controlling the drive unit (20), and a measurement section comprising a transmitter device (22) and a receiver device (24). The control device or control circuit is configured so as to control the drive unit (20) in accordance with a signal generated by the receiver device (24). The transmitter device (22) is provided with a laser module that is aimed directly at the receiver device (24). Said laser module generates a laser beam (25) which is deflected in accordance with the presence of cooking vapors such as steam. The respective deflection influences the signal generated by the receiver device (24) such that the signal allows the control device or control circuit to draw conclusions about the presence of cooking vapors such as steam or movements of air and thus automatically control the drive unit (20) as needed.

20 Claims, 7 Drawing Sheets

U.S. PATENT DOCUMENTS

| | | | | | |
|---|---|---|---|---|---|
| 4,781,460 | A | * | 11/1988 | Bott | 356/336 |
| 4,903,685 | A | | 2/1990 | Melink | |
| 4,980,571 | A | * | 12/1990 | McRae et al. | 250/573 |
| 5,074,281 | A | | 12/1991 | Fluhrer et al. | |
| 5,146,284 | A | * | 9/1992 | Tabarelli et al. | 356/487 |
| 5,693,949 | A | | 12/1997 | Paris | |
| 5,882,254 | A | * | 3/1999 | Jacob | 454/61 |
| 6,037,580 | A | * | 3/2000 | Renk | 250/221 |
| 6,078,040 | A | * | 6/2000 | Endo et al. | 250/222.2 |
| 6,170,480 | B1 | | 1/2001 | Melink et al. | |
| 6,198,110 | B1 | * | 3/2001 | Kaye et al. | 250/575 |
| 6,583,726 | B1 | * | 6/2003 | Johnson et al. | 340/627 |
| 6,822,216 | B2 | * | 11/2004 | Lang et al. | 250/221 |
| 2004/0090627 | A1 | * | 5/2004 | Hinderling | 356/436 |
| 2006/0032492 | A1 | * | 2/2006 | Bagwell et al. | 126/299 R |

FOREIGN PATENT DOCUMENTS

| | | | | |
|---|---|---|---|---|
| DE | 19509612 | | | 3/1996 |
| DE | 200 21 349 | U1 | | 4/2001 |
| DE | 201 21 682 | U1 | | 3/2003 |
| EP | 0603538 | | | 6/1994 |
| EP | 0 788 082 | B1 | | 10/2002 |
| JP | 06281219 | A | * | 10/1994 |
| WO | WO 9118280 | A1 | * | 11/1991 |

OTHER PUBLICATIONS

International Search Report corresponding to International Application No. PCT/EP200/011296 dated Feb. 2, 2006.

* cited by examiner

VENTILATION DEVICE, PARTICULARLY AN EXHAUST HOOD WITH AIR FLOW CONTROL MEANS

CROSS REFERENCE TO RELATED APPLICATIONS

This application is a continuation of PCT/EP2005/011296, filed on Oct. 20, 2005 and claims priority from German Application No. 10 2004 052 201.4, filed Oct. 20, 2004, and German Application No. 102005015754.8, which was filed Mar. 30, 2005.

FIELD OF APPLICATION AND PRIOR ART

The invention relates to a ventilation device, particularly an exhaust hood and means for controlling same.

Foreign patent DE 195 09 612 C1 discloses exhaust hoods, which are provided with a transmitter and a receiver, the transmitter emitting radiation which is detected by the receiver. The radiation received by the receiver is used for controlling a ventilator of the exhaust hood in that the difference between the emitted radiation and the received radiation component is interpreted as a measure for the quantity of exhaust gases in the exhaust air flow. The power supply to the ventilator is controlled as a function thereof.

Foreign patent EP 443 141 B1 describes an exhaust hood with an ultrasonic transmitter and an ultrasonic sensor system, in which the signal variations recorded by the ultrasonic sensor system are used as a basis for controlling a ventilator stage. It is considered disadvantageous in this connection that the ultrasonic sensor system is expensive and therefore use can only be made thereof for high price exhaust hoods.

The problem addressed by the invention is to provide a ventilation device of the aforementioned type making it possible to avoid the disadvantages of the prior art and in particular providing an inexpensive, reliable monitoring of a cooking process and the associated air contamination, such as is e.g., caused by cooking vapours or air movements over a hob or cooktop.

BRIEF DESCRIPTION OF THE DRAWINGS

Embodiments of the invention are described in greater detail hereinafter relative to the diagrammatic drawings, wherein.

DETAILED DESCRIPTION

Figure 1:
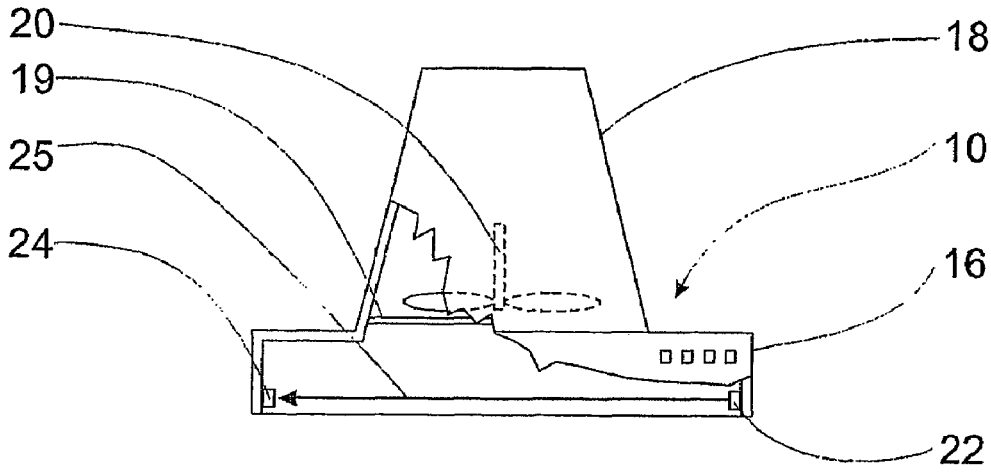
FIGS. 1 & 2 illustrate a part sectional views of a first embodiment of the inventive exhaust hood, in which the transmitter and receiver devices are located on opposite insides of the exhaust hood and in which a laser beam is emitted directly towards the receiver device.

This problem is solved in one embodiment by a ventilation device having the features of claim 1. Preferred and advantageous developments of the invention are given in the remaining claims and are discussed in greater detail hereinafter. By express reference the wording of the claims is made into part of the content of the description.

According to the invention, the transmitter device is constructed for emitting a laser beam. The use of a laser beam is both economically and technically advantageous. Through the emission of virtually parallel laser light by a laser light transmitter, it is possible to obtain a clearly defined intensity relative to the cross-sectional surface of the laser beam. This permits the implementation of longer measurement sections within the ventilator, without a suitable evaluation being made more difficult through an excessive expansion of the light cone. If the laser beam emitted by the transmitter device encounters air contamination such as cooking vapours or fluctuating air density gradients, it is refracted, diffracted, deflected and/or scattered. As a result the power recorded by the receiver device changes compared with the output power of the transmitter device. These power changes, and also the frequency of the power fluctuations, are dependent on the quantity of air contamination and/or the measurement of the air movement on the measurement section. In the case of exhaust hoods the quantity of the cooking vapours, such as fumes and steam, the power changes are also dependent on so-called "air streaks" as a consequence of the heat evolution on the hob. Air streaks are made prominent by air movement and air regions of different density. The good detectability of air streaks and air movements in the case of the ventilation device according to the invention is particularly advantageous, because as a result, operation of the ventilation device can be initiated and adapted earlier compared with particle detection. If it is only the occurrence of particles which initiates operation, there is a serious risk of the air contamination or cooking vapours having already arisen and evolved, so that they are no longer detected by the ventilation device.

The use of a laser beam offers special advantages, because in the case of a laser beam the frequency is largely uniform, so that use can be made of receiver devices which are in particular set up for the specific laser frequency or a narrow frequency range. As a result the ambient light, which normally occurs in a wide frequency spectrum, does not lead to misinterpretations by the control device or a control circuit. In addition, the use of a laser beam permits long and multiple deflected measurement sections allowing a particularly precise detection of air contamination. Also from the economic standpoint, the use of a laser beam is very advantageous.

Nowadays, laser modules are mass-produced products, so that they are very reliable and also inexpensively obtainable.

According to a further development of the invention, the signal generated by the receiver device, with respect to electrical characteristic values such as its frequency, voltage or current strength, is dependent on the power or intensity of the radiation received. Corresponding sensors and receiver modules, which as a function of the irradiation of light generate corresponding electric signals, are well known. When using a control device with a microcontroller, it is e.g. possible to use a receiver device, whose emitted signal, with respect to the voltage, is dependent on the incident light. Said signal is connected to an A/D converter input of the microcontroller and can consequently be processed by the microcontroller. Appropriately, use is also made of a sensor, whose frequency is dependent on the power of the radiation received, because no A/D converter is needed for such a frequency measurement.

According to a further development of the invention, the signal generated by the receiver device is solely dependent on the incident radiation in a frequency range, which largely corresponds to the frequency range of the laser beam. This avoids interfering influences by ambient light or, e.g., a lighting system integrated into an exhaust hood. The restriction to such a frequency range can, e.g., be technically implemented by means of a filter positioned upstream of a sensor in the receiver device or by means of special sensors, which are constructed for the exclusive reception of light in the corresponding frequency range.

According to a further development of the invention the receiver device has a photoelectric sensor, which preferably has a photosensor or a photodiode. Such sensors form part of the prior art and are inexpensive.

In a further development of the invention, the receiver device is equipped with filter means, which restricts the angular range in which the incident light is recorded by the receiver device. Apart from the use of corresponding flat filters, it is particularly appropriate to provide the receiver device with an angle narrowing device, which only allows light incidence in a confined angular range, e.g., with a hollow duct oriented towards the laser beam. Much the same is achieved in that the receiver device is located on the bottom of a hole provided for this purpose.

According to a further development of the invention, the drive unit can be activated and deactivated by the control circuit or control device, and is controllable, preferably in a stepless manner with respect to its power level. Numerous combinations are conceivable and appropriate. The control device can, e.g., be constructed in such a way that completely independently it activates the drive unit for generating the air flow, provided that a corresponding need has been detected, and also correspondingly adapts the necessary power. However, it is also possible that only the drive unit power is automatically controlled, whereas activation and deactivation of ventilation is operated manually by an operator. A stepless control of the power makes it possible to implement operation in accordance with the needs of the user. However, it is advantageous when controlling the power with different discrete stages that such a control is simpler and less expensive.

In a further development of the invention, the control circuit or control device for evaluating the signal generated by the receiver device is constructed with different density gradients in the measurement section with respect to the air streaks or air movements. The control device is then constructed in such a way that it interprets smaller vapour emissions in such a way that a reduced particle quantity and/or air streaks on the measurement section are detected. The extent that the vapour emission can be attributed to particles or air streaks, can be decided on the basis of further parameters such as the oscillation frequency. A control device constructed for evaluating the signal with respect to air streaks or movements activates a ventilation device in the case of even limited vapour emissions and in this way permits a very appropriate ventilation control in a time period at the start, or even before, air contamination occurs. Preferably, the ventilation device has an adjustable operation, so that independent of varying ambient situations, e.g. the use above hotplates or gas flames, it can be operated in the correct situation and to the correct extent.

According to a further development of the invention, the control circuit or control device is constructed for controlling the drive unit as a function of the recorded intensity or power of the receiver device. For this purpose, the power is compared with the power or intensity emitted by the transmitter device or with a fixed desired power or desired intensity and a reduction is interpreted as indicating absorption, refraction and/or diffraction as a consequence of cooking vapours or air streaks or movement. The control can be constructed in such a way that a reduced recorded power is interpreted as an increased level of contamination of the air, e.g., by cooking vapours, and as a consequence the drive unit power is increased.

In an advantageous further development of the invention, the control circuit or control device for controlling the drive is constructed as a function of the intensity or power over time recorded by the receiver device. In particular, the use of the first derivation of the power on a time basis is superior to purely controlling the ventilation on the basis of the recorded power. Rapid changes to the power can be attributed to turbulence in general or cooking vapours in the vicinity of the measurement section and are a sign of a high concentration of air contamination, such as cooking vapours or air movements. A control of the drive unit as a function of a change to the recorded intensity or power can also be combined with an evaluation of the intensity or power. In this way, both the frequency and the amplitude of the power pattern over time is used for analyzing the contamination on the measurement section. The incorporation of the power change over time leads to a particularly good control of the drive unit oriented on the basis of needs. Such a control based on the frequency of power fluctuations can e.g. be implemented in that the number of intensity maxima or minima in a time period of clearly defined length is counted and the control of the ventilation takes place on the basis of the mean value. In conjunction with exhaust hoods for the kitchen sector, it has proved particularly appropriate to interpret a high signal attenuation, in the case of a weak oscillation of the signal, as an indication of a high quantity of vapours or strong air movement requiring a high ventilation power level. Strong oscillation can be interpreted independently of the degree of vapour emission as normal cooking operation or a gradual termination of cooking operation, so that the ventilator is appropriately placed in a main use stage or a residual suction stage.

According to a further development of the invention, the transmitter device is constructed for emitting a laser beam, whose luminous light points or spots in the vicinity of the receiver device has areas of widely differing intensity, preferably in the form of an interference pattern. Maxima and minima can alternate and are in particular produced by interference. Such a light spot can not only be detected by the receiver device as to whether it strikes the receiver device or sensor, but also the displacement of the light spot on the photodiode leads to a characteristic result impacted by the presence of air streaks and particles in the measurement section, without the light spot being deflected to such an extent that it necessarily leaves the photodiode. The particularly advantageous evaluation of interference patterns can be brought about by the use of a laser with a comparatively wide frequency spectrum. Although for other aspects of the invention it can be advantageous to use a laser with a particularly narrow frequency spectrum, as a function of requirements, it can consequently also be advantageous to use a multimode laser diode with a wide frequency spectrum.

In a further development of the invention, the transmitter device and receiver device are constructed in such a way that in operation the receiver device is always within the light spot. With such a design, it is not the light spot migrating down from the receiver device or photodiode, which in correct manner influences the output signal of the receiver device, but instead it is the movement of the light spot over the receiver device. In particular, the maxima and minima of the interference pattern of the light spot move over and beyond the sensor. The size of the sensor should be such that it is smaller than the extension of the maxima and minima, and they can also be influenced by optical aids such as lenses. The advantage is, in particular, that there is no need for precise calibration of the receiver device and transmitter device and such a ventilation device has a very limited fault susceptibility. The detecting of the movement of the light spot over the receiver device can e.g. take place accompanied by the evaluation of a moving interference pattern with maxima and minima. This can advantageously be used for controlling the exhaust hood with a corresponding control method, which evaluates the output values of the sensor in the case of an interference pattern moving over the same.

In a further development of the invention, the transmitter device and receiver device are constructed in such a way that the light spot diameter is a few millimetres (mm) wider than the receiver device, preferably at least 5 to 58 mm wider. This leads to a particularly low fault susceptibility. There are frequently large manufacturing tolerances in the ventilation device sector. Due to the fact that the operation of the transmitter and receiver device in said development is not dependent on the transmitter and receiver device being precisely at the intended desired position, more favourable manufacturing methods can be used and no additional measures are needed for ensuring the correct, highly precise orientation of said devices.

In a further development of the invention, the control circuit or control device evaluates the output signal with respect to signal frequency and signal attenuation. This is particularly appropriate when using a laser beam which is so pronounced that in normal operation it always rests on the receiver element and which has a light spot with areas of widely differing intensity. With such a constellation the recorded intensity or the established attenuation of the laser beam can be used for indicating the presence of vapour and the frequency can be used for indicating the presence of heat. Together these parameters are well suited to permit an estimate of the nature of the process taking place under the ventilation device and to generate a correspondingly adapted air flow. Strong attenuation can be used as an indicator for an intense cooking operation and a high signal frequency as an indicator of an intense baking or roasting operation.

In a further development of the invention, the transmitter device and receiver device are positioned facing one another on either side of the air flow in the ventilation device and the transmitter device emits in the direction of the receiver device. This represents the simplest construction of receiver device and transmitter device. The transmitter device and receiver device are preferably placed on opposite sides of the air flow and in particular centrally over the hob, so that the measurement section crosses or intersects the air flow. Such an arrangement with a direct orientation of transmitter and receiver devices to one another is simple and relatively unsusceptible to faults.

According to a further development of the invention the transmitter device and receiver device are positioned in such a way that a laser beam from the transmitter device passes to the receiver device after reflection by at least one reflection device. The use of such a reflection device is appropriate, because on the one hand it extends the measurement section and consequently allows a more precise measurement. On the other hand, it makes it possible to incorporate a larger area of the ventilator into the measurement. A reflection device also makes it possible to position the transmitter and receiver devices very close to one another, in that said devices are located on one side of the ventilator, the reflection device being located on the other side. This also permits the construction of the receiver and transmitter devices as a single module, which significantly reduces assembly and adjustment costs compared with the use of two separate modules.

According to a further development of the invention, there are at least two reflection devices, which are so positioned and oriented that a laser beam from the transmitter device is reflected at least twice by at least one reflection device on its passage to the receiver device. This makes it possible to implement a long measurement section with a small number of reflection devices, preferably two reflection devices, so that reliable conclusions can be drawn concerning contamination in the air, such as air movements and cooking vapours.

In a further development of the invention built up on the same, both reflection devices face and are parallel to one another. This makes it possible for both reflection devices to reflect the laser beam several times. The reflection devices can e.g., be located on the front and rear or on the left and right inside of the ventilation device or exhaust hood. Through correspondingly positioned and oriented transmitter and receiver devices, it is possible to reflect the laser beam several times from one side to the other and therefore to base virtually the entire cross-section of the ventilation device on a subsequent evaluation by the control device or control circuit.

In a further development of the invention, the transmitter device has a laser diode for emitting the laser beam and in particular a multimode laser diode. Multi-mode laser diodes emit light at different frequencies and for technical reasons are very suitable for the proposed ventilation devices. The radiation beam emitted by them has an increased divergence compared with single mode laser diodes and an increased diffraction tendency due to the increased wavelength spread. Due to their frequency spectrum they also generate an interference pattern in the light point which, as described hereinbefore, allows a particularly good evaluation with maxima and minima and a limited fault susceptibility. The increased divergence and interference pattern are particularly advantageous for the detection of air streaks. Particularly suitable for good evaluation is a light spot diameter of 5 to 15 mm, particularly 10 mm. An excessive focusing of the laser beam can be disadvantageous for air streak detection. To improve air streak and air movement detection, it can be appropriate to provide means to further increase the multimode laser diode divergence.

In a further development, the transmitter device has a collimator lens, which permits an appropriate optimization of the transmitter device through the adaptation of the position of its focal point. By means of the position of the collimator lens and/or its focal point it is possible to vary the expansion of the laser beam in the vicinity of the receiver device. The laser beam can also be made somewhat divergent. An increased expansion increases the sensitivity of the receiver device, particularly with regards to air movements, so that a more readily interpretable signal is supplied to the control device. Thus, the control device controls the ventilator in accordance with needs and in particular this happens prior to the production of vapours. However, an expansion of the laser beam also leads to a reduced light efficiency received by the receiver device. By adapting the collimator lens with regards to position and type, it is possible to produce an optimum laser beam divergence with respect to light efficiency, as well as air streak and cooking vapour detection. When using a separate lens there is no need for a finished laser module and an inexpensive construction of laser diode and lens is obtained.

According to a further development of the invention, the laser beam divergence can be adjusted by the control device or control circuit. As the attenuation of reduced divergence laser beams by air streaks is less than the attenuation of high divergence laser beams, through an adjustability of the divergence, it is possible to ensure that a particularly reliable distinction can be made between the attenuations caused by vapours or particles on the one hand and air streaks or air movement on the other. Thus, the control device of such a ventilation device can e.g., alternately measure attenuation at high and low divergence and in the case of a limited attenuation which is only due to air streaks can put the ventilator into operation. Adjustability is preferably brought about by means of an adjustable lens.

In a further development of the invention, there are at least two transmitter devices for emitting laser beams with differing divergence. Also using two transmitter devices in the case of a different divergence setting it can be ensured that the cause of attenuation on the measurement section is reliably detected. Compared with an embodiment with a divergence-adjustable laser beam, this avoids adjustability and the resulting increased complexity of the transmitter device. Preferably, both transmitter devices are directed at a single receiver device either measuring at the same time or in alternating manner the incident power of the laser beams. However, it can also be appropriate to associate an individual receiver device with each transmitter device.

These and further features of preferred developments of the invention can be gathered from the claims, description and drawings and the individual features, both singly or in the form of subcombinations, can be implemented in an embodiment of the invention and in other fields and can represent advantageous, independently protectable constructions for which protection is claimed here. The subdivision of the application into individual sections and subheadings in no way restricts the general validity of the statement made thereunder.

Figure 2:
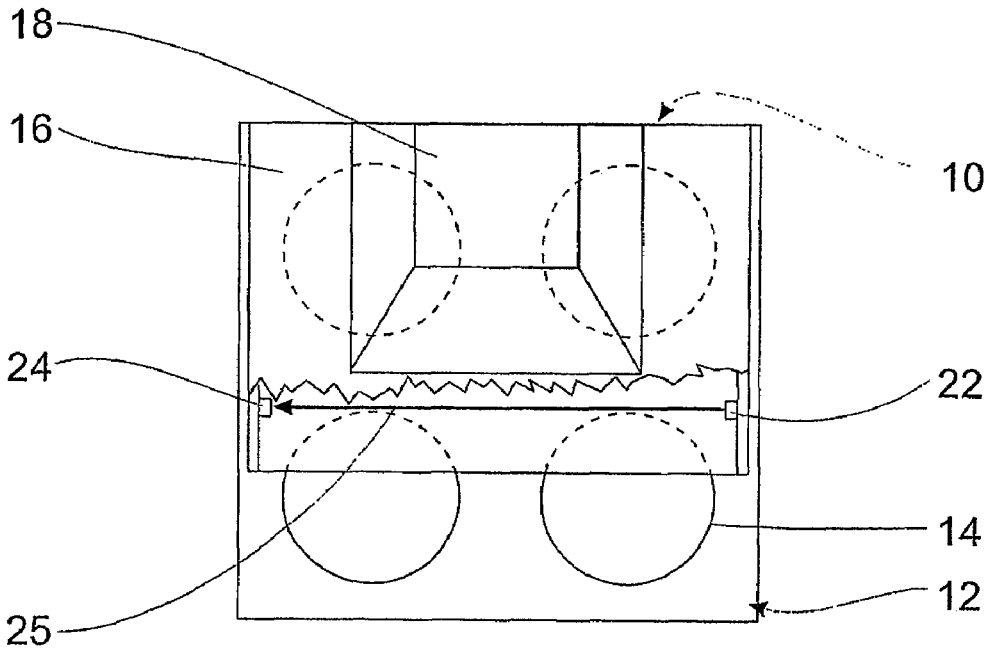

FIGS. 1 and 2 show in part sectional form a first embodiment of an inventive ventilation device in the form of an exhaust hood 10. Exhaust hood 10 is placed above a hob (cooktop) 12 having four hotplates 14. Exhaust hood 10 extends virtually over the entire width of hob 12 and covers roughly three quarters of its depth. Exhaust hood 10 comprises a box-shaped lower part 16 open at the bottom and an upper part 18, lower part 16 and upper part 18 being so interconnected that the cooking vapours such as steam and fumes emanating from hob 12 pass into the lower part 16 of exhaust hood 10 and from there are passed into the upper part 18. In the transition area between lower part 16 and upper part 18 are provided a filter mat 19 and a fan 20, which sucks the kitchen vapours through filter mat 19 into upper part 18. In the lower part 16 are provided a transmitter device 22 with laser and a receiver device 24 on the right or left inside. Transmitter device 22 is oriented in such a way that a laser beam 25 therefrom is directed directly onto the receiver device 24.

If during cooking, cooking vapours rise from hotplates 14 of hob 12, they pass into the lower part 16 of exhaust hood 10. Laser beam 25, which is activated permanently or in periodic intervals, is partly absorbed, as well as partly diffracted and refracted by said cooking vapours. Thus, the input power to the receiver device 24 is reduced compared with the output power.

However, even before cooking vapours have arisen or entered the area of the measurement section between transmitter device and receiver device 24, as a result of the heat emanating from hotplate 14, air movements arise in the vicinity of the measurement section and cause diffraction of the laser beam, which also reduces the input power at receiver device 24.

In a way not illustrated in FIGS. 1 and 2, a signal generated by receiver device 24 is supplied to a control device which, on the basis of the power difference between the output power of transmitter device 22 and the input power of receiver device 24 and on the basis of the time change of such power difference, draws conclusions regarding the degree of the air movements and the presence and quantity of cooking vapours. As a function of the thus determined quantity of air streaks and/or cooking vapours, said control device controls the power supplied to fan 20 and the power is increased if the air movement is intense or there is a high quantity of cooking vapours. If the input power at receiver device 24 during the purification of the air again approaches the output power of transmitter device 22 and is no longer subject to major fluctuations, fan 20 can again be throttled or completely deactivated by the control device.

Figure 3:
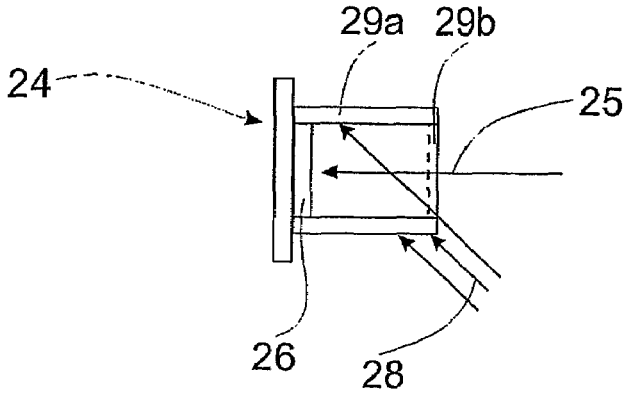
FIG. 3 illustrates a detail view of the receiver device of the exhaust hood shown in FIGS. 1 and 2.

FIG. 3 shows on a larger scale the receiver device of the exhaust hood shown in FIGS. 1 and 2. The receiver device has a tubular section 29*a*, whose major axis coincides with the incidence axis of laser beam 25. On the bottom of said tubular section 29*a* is provided a photoelectric sensor 26 which, as a function of the incident power, generates a corresponding signal. At the opposite end of tubular section 29*a* is provided a filter 29*b* used for filtering the incident light and which only permits the passage of light in a specific frequency range matched to the laser beam. If there is light of a different frequency range it is absorbed by filter 29*b* and consequently does not reach the photoelectric sensor. The same applies regarding light of any frequency striking the receiver device 24 from a direction 28 diverging from the laser propagation direction. As a result of these two measures, namely tubular section 29*a* and filter 29*b*, the signal emitted by photoelectric sensor 26 is determined exclusively or almost exclusively by the incident power of the laser beam and not the ambient light.

Figure 4:
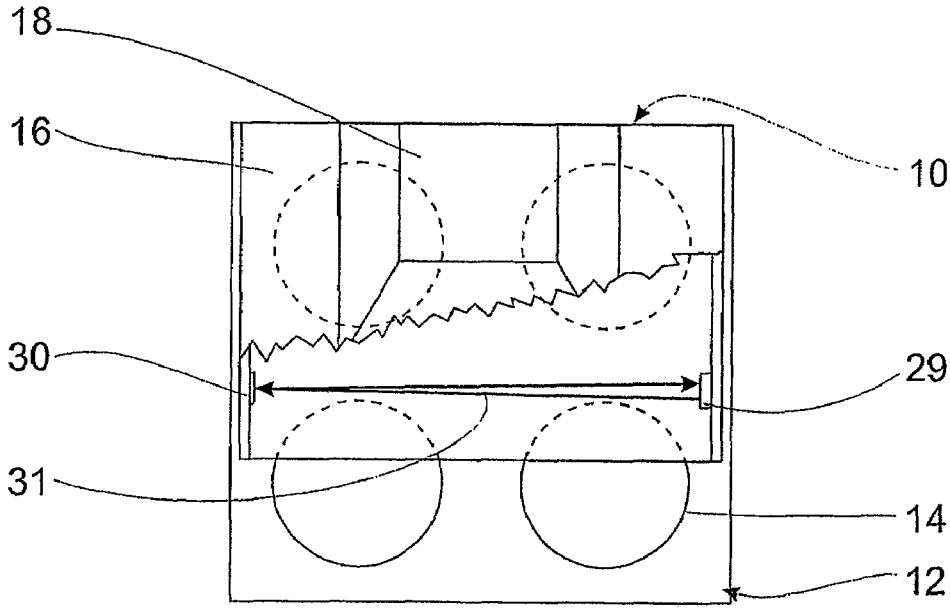
FIG. 4 illustrates a part sectional view of a second embodiment of an inventive exhaust hood, in which the transmitter and receiver devices are provided as a unitary module on an inside of the exhaust hood and in which a reflection device is provided on the opposite side of the exhaust hood.

FIG. 4 shows a second embodiment of an inventive exhaust hood. Unlike in the first embodiments in the present case the transmitter and receiver devices are housed in a common functional module 29 located on the inside of the lower part 16 of exhaust hood 10. A reflection device 30 is located on the opposite inside of lower part 16 and can e.g. be a mirror or a cat's eye. Laser beam 31 emitted by functional module 29 is oriented towards the reflection device 30, which reflects it in such a way that it passes back to functional module 29 only slightly diverging from its path prior to reflection. The receiver device integrated in said functional module 29 records the returned power and in the same way as in the first embodiment emits to a not shown control device a signal dependent thereon. The advantage of this embodiment is that only one module has to be connected to the control device, which economizes wiring costs and obviates constructional difficulties. In addition, in the second embodiment the measurement section is roughly twice as long as in the embodiment of FIGS. 1 and 2, so that more reliable results are obtained.

Figure 5:
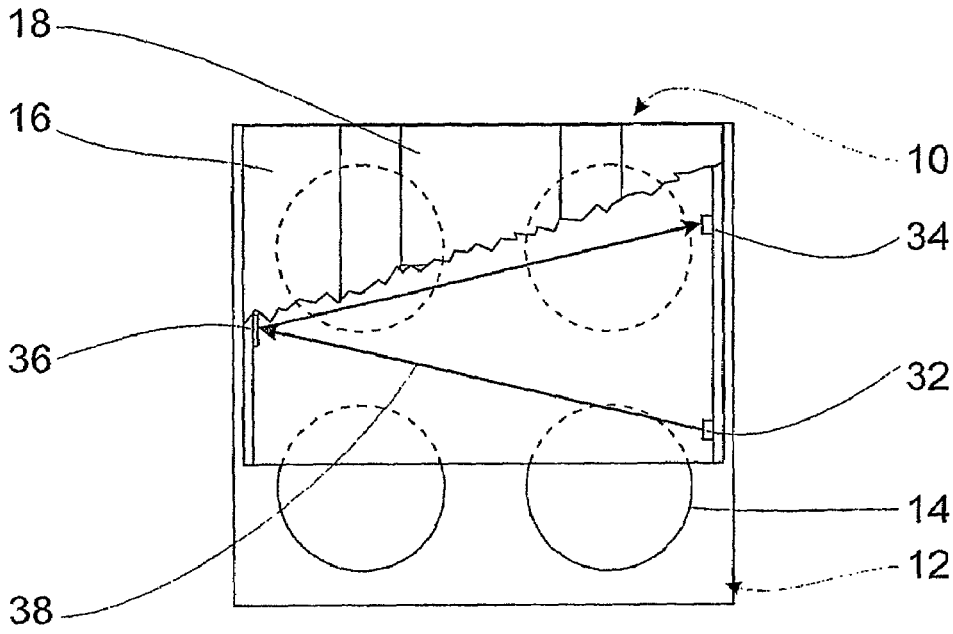
FIG. 5 illustrates a part sectional view of a third embodiment of an inventive exhaust hood, where the transmitter and receiver devices are also located on the same inside of the exhaust hood, but this involves separate, spaced modules.

FIG. 5 shows a third embodiment of an inventive exhaust hood. Compared with the second embodiment of FIG. 4, said embodiment differs in that the transmitter device 32 and receiver device 34 are in the form of separate modules, but are placed on the same inside of lower part 16 of exhaust hood 10. Once again, on the opposite inside is provided a reflection device 36, which is so positioned and oriented that a laser beam 38 from transmitter device 32, after reflection, strikes receiver device 34. This embodiment admittedly suffers from the disadvantage that the transmitter and receiver devices have to be connected separately from one another to a not shown control device. However, it is advantageous that, before and after reflection by the reflection device 36, laser beam 38 does not have a virtually parallel path. This increases the area through which the laser beam passes. Consequently, cooking vapours of all the hotplates can be reliably detected and the fan 20 can be controlled in a corresponding, well adapted manner.

Figure 6:
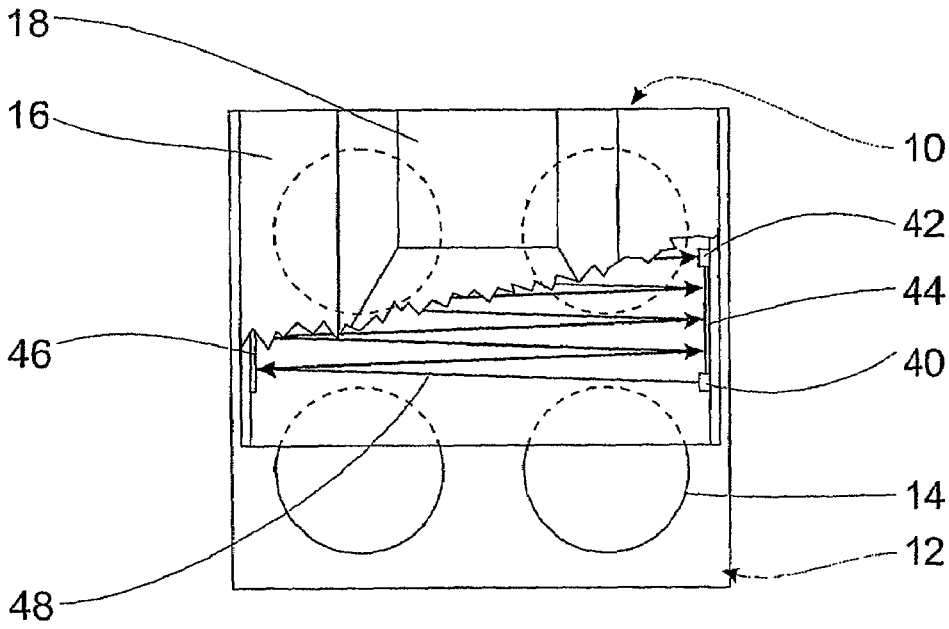
FIG. 6 illustrates a part sectional view of a fourth embodiment of an inventive exhaust hood, in which two parallel reflection devices are provided on opposite insides of the exhaust hood.

FIG. 6 shows a fourth embodiment of an inventive exhaust hood, which has a transmitter device 40 and a receiver device 42, which are once again located on the same inside of lower part 16 of exhaust hood 10. Compared with the embodiments shown in FIGS. 4 and 5, this embodiment differs in that both on the inside of transmitter and receiver devices 40, 42 and on the opposite side is in each case provided a reflection device 44, 46. The two reflection devices are oriented parallel to one another. Transmitter device 40 is so oriented that the laser beam 48 therefrom is reflected several times by reflection devices 44, 46 before it reaches the receiver device 42. This leads to a comparatively long measurement section enabling particularly precise conclusions to be drawn concerning the presence of cooking vapours and the like. Moreover, with this or a similar structure, it is possible to cover in a largely surface-covering manner the area over the hotplates 14, so that even a locally limited occurrence of cooking vapours can be rapidly and reliably recorded. Precisely with such a structure, it is ideal to use a laser. As a result of the limited expansion of the laser beam 48, even long measurement sections can be implemented without difficulty.

Figure 7:
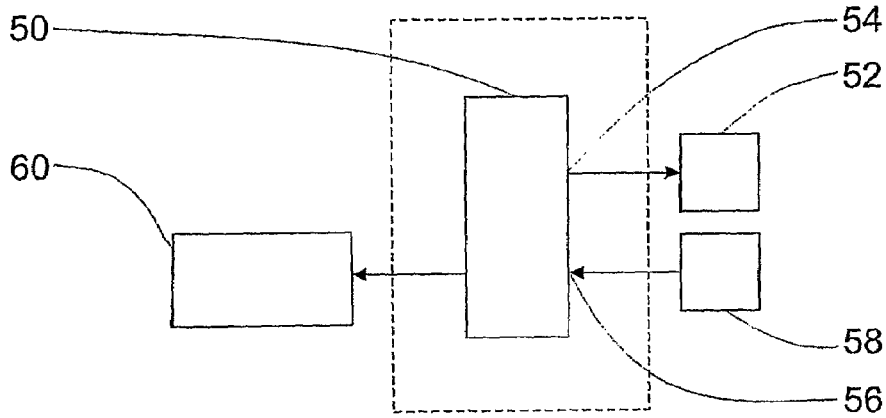
FIG. 7 illustrates a diagrammatic representation of a control device for an inventive ventilation device and with components connected to said control device.

FIG. 7 shows a control device of an inventive exhaust hood, as well as components connected thereto. The control device has a control circuit 50 provided with a number of terminals. A transmitter device 52 is connected to a PWM output 54 (pulse width modulation output) of control circuit 50. In this way the control circuit is able to control in planned manner the power of transmitter device 52 and in particular the laser integrated into said transmitter device 52. This permits a basic adjustment in which the laser is set in such a way that a desired input power is recorded at the receiver device, e.g. the input power occurring with a complete irradiation of the entire surface of the sensor of the receiver device. To an A/D converter input 56 is connected a receiver device 58 having at least one photoelectric sensor which, as a function of the incident light quantity, varies the voltage supplied to the control circuit 50. On the basis of the thus received measured values of receiver device 58, by means of a circuit or program in control circuit 50 provided for this purpose it is possible to detect whether there are cooking vapours on the measurement section between transmitter device and receiver device 58 and what density or degree of turbulence they have. As a function of the result of this analysis a fan motor 60 is controlled and its power can be controlled by the control circuit 50. If there is a high quantity of cooking vapours, the fan motor 60 is so controlled that said vapours are sucked off with high power.

Figure 8A:
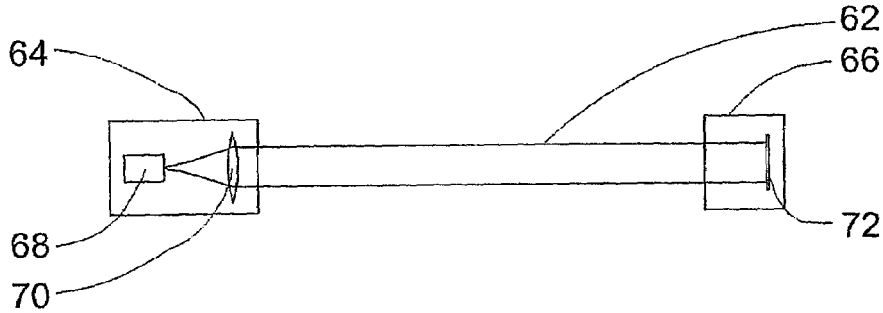
FIGS. 8*a* & 8*b* illustrates the optical path of a laser beam in the vicinity of a measurement section.
Figure 8B:
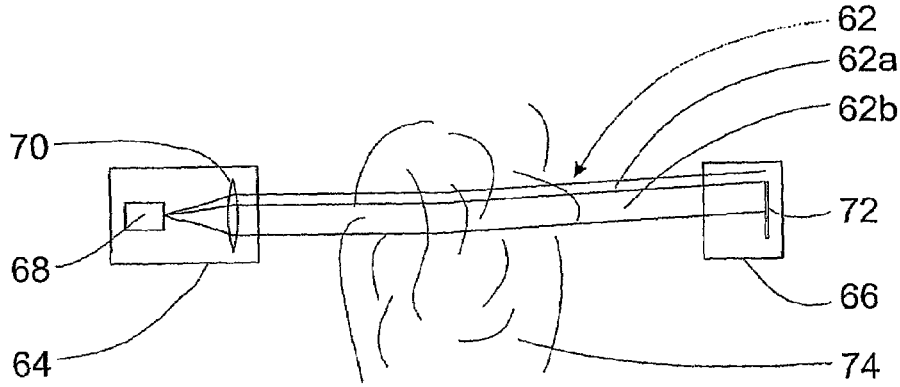

FIGS. 8*a* and 8*b* show the optical path of a laser beam 62 of an inventive ventilation device in the region of a measurement section between a transmitter device 64 and a receiver device 66. Transmitter device 64 has a laser module 68 and a collimator lens 70 which somewhat expands the laser beam 62 from laser module 68. The laser beam 62 traverses the measurement section and encounters photoelectric sensor 72 in the receiver device. With respect to its surface area, photoelectric sensor 72 is so constructed and the laser beam 62 so set that said beam 62 in an uninterrupted, undeflected state is completely detected by photoelectric sensor 72 and the surface thereof is substantially completely irradiated. As a function of the recorded power photoelectric sensor 72 generates an output signal for a control device of the ventilation device. In different ways said signal can transfer the information concerning the recorded power, e.g., by a correspondingly adapted voltage, through an adapted frequency or by means of other electric characteristic quantities.

FIG. 8*a* shows the uninterrupted, undeflected state of laser beam 62. In this state the maximum power is recorded by photoelectric sensor 72 and a corresponding signal is transmitted to the not shown control device. If such a signal is constantly transmitted to the control device it is interpreted by the latter to the effect that no cooking vapours and steam are present on the measurement section and there is no need to activate the ventilation device fan.

FIG. 8*b* shows a second state of the same measurement section, where there is steam 74 on the measurement section. The laser beam 62 from transmitter device 64 is interrupted by the different steam concentrations and therefore reaches the photoelectric sensor 72 in a deflected and therefore only partial manner. One component 62*a* does not reach photoelectric sensor 72, so that the power recorded by the latter is only a remaining component 62*b*. An electric characteristic quantity giving information on the magnitude of this component is transmitted to the control device in the form of a corresponding signal. By means of an activation or a power control of the fan, this can give rise to the sucking off of the steam. Reference numeral 74 can also refer to air streaks, which are in part visible to the naked eye.

FIGS. 8*a* and 8*b* show the deflection of laser beam 62 and the resulting change to the recorded power. Fan control can take place in such a way that said component is used directly as a criterion for recording air movements or air contamination such as cooking vapours and a direct relationship can be assumed between the recorded power and air movements or contamination. The control of the fan can additionally or exclusively take place by means of the dynamic change to the recorded power. In the case of such a control, the control device e.g. evaluates with what frequency and/or what amplitude the recorded power is modified. The power frequency is particularly high when there is a large quantity of cooking vapours, so that a control of the fan as a function of the frequency leads to very good results.

Figure 9:
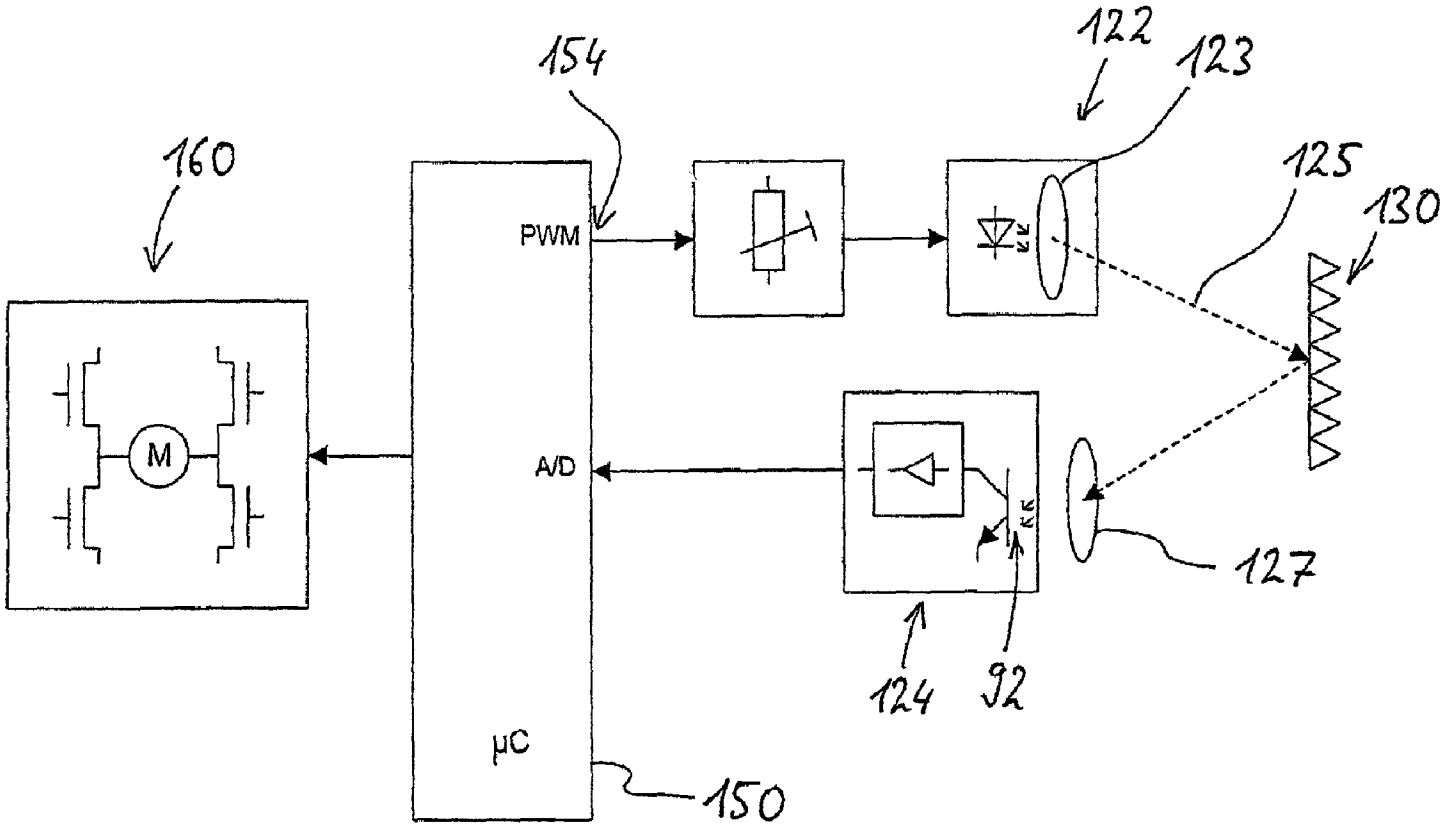
FIG. 9 illustrates a view of the control and evaluation functional units.
Figure 11:
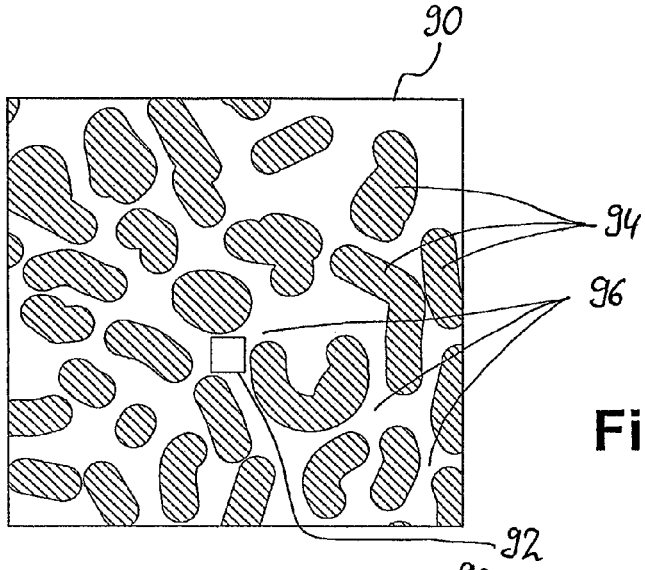
FIGS. 11 & 12 illustrates diagrammatic representations of the movement of individual light spots from the laser interference pattern over the receiver device.
Figure 12:
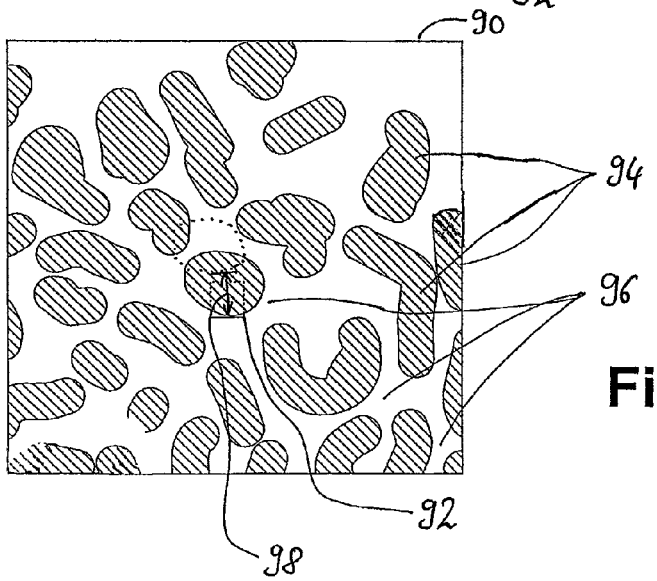

FIG. 9 with the diagrammatic structure, together with FIGS. 11 and 12 illustrate an alternative method to the evaluation system of FIGS. 8*a* and 8*b*.

Based on FIGS. 1-4 and 7, FIG. 9 shows a transmitter 122 with a laser diode or laser module, upstream of which is provided a collimator lens 123 from which emanates the correspondingly expanded, parallel laser beam 125. It is reflected at reflector 130, which can also be a so-called cat's eye. In certain circumstances this can take place several times, as stated hereinbefore. The reflected laser beam 125 passes through a Fresnel lens 127 to receiver 124 or its sensor 92. The electrical signal detected by sensor 92 is passed to the A/D converter input and therefore to control circuit 150. Control circuit 150 can be a microcontroller and in addition to controlling transmitter 122 via PWM output 154, controls the motor or power electronics 160.

The control circuit has the intelligence to control on the basis of the already described and in particular subsequently described processes the exhaust hood. This is more particularly intended to take place automatically as a function of the state at hob 12 and without involving the intervention of an operator, whilst efficiently and effectively performing the exhaust function.

In this method for determining the ventilation requirements, the diameter of the laser light spots 90, which are generated upstream of the receiver by the interference pattern and the Fresnel lens in accordance with FIG. 9, is much larger than the photoelectric sensor 92. FIGS. 11 and 12 only show a small detail of light spot 90. The latter is generated by a laser diode with a comparatively wide frequency spectrum leading to an interference pattern with maxima 94 and minima 96. This interference pattern is shown in relatively irregular form here which is generally the case in practice due to a non-optimum construction of the Fresnel lens and the remaining optical path. Independently of the specific size of the maxima 94, the specific mutual spacing, i.e. the size of the minima 96 is important.

If there is a deflection of the laser beam 125 through air movements or also particles such as steam on the measurement section, even very minor displacements of the light spot 90 and consequently maxima 94 and minima 96 relative to photoelectric sensor 92 are sufficient to significantly modify the intensity measured by the sensor. As the maxima 94 so-to-speak dance over the sensor 92, i.e. their movement path is much greater than their diameter and that of the sensor, a time-averaged intensity is detected to a lesser extent at sensor 92. Instead the sensor 92 detects the frequent or multiple movement above the same of different maxima in the form of short peaks. As the speed of light spot 90 and consequently maxima 94 is relatively high and during sensor movement they substantially completely or do not cover the same, the peaks can be readily differentiated or detected. As around each maximum there is space from the neighbouring maximum or minima 96 are located between the same, it is also ensured that after each passage through a maximum 94 over sensor 92 the latter records no light in the minimum. This leads to a good differentiation. It is important in general that the surface area of the maxima 94 is roughly the same as sensor 92 and is advantageously two to four times higher. This relationship can be influenced by means of maxima 94 or the sensor. Once again light spot 90 is much larger and should always cover sensor 92.

This is apparent from the difference between FIGS. 11 and 12. Whereas in the state of FIG. 11 the sensor is in the vicinity of a minimum 96, so that the output signal is zero, following a displacement of the maximum 94 compared with the dotted line earlier position by a very limited distance 98, in practice below 1 mm, it is largely in the vicinity of said maximum. This leads to a high output signal and a peak is formed. The frequency of this alternation gives the oscillation or its frequency. The difference between zero and the peak maximum gives the intensity and from this can in turn be derived the attenuation.

Figure 10:
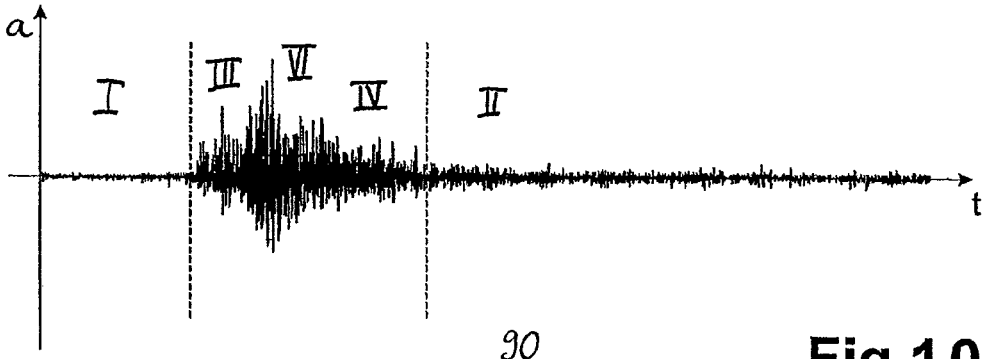
FIG. 10 illustrates a graph of the measured values of the time behaviour of the intensity of the incoming signal.

FIG. 10 shows the time curve as to how the individual peaks as individual spikes in the overall path give rise to a type of noise. However, good detection is still possible or evaluation can take place optically via sensor 92 and electronically via the control means. It must be borne in mind that in FIG. 10 the attenuation a is shown over time t or over the time curve of the cooking process. The actual intensity of the measured maxima 94 at sensor 92 is so-to-speak the reciprocal of the attenuation. The change to the frequency of oscillation or movement of the maxima is difficult to detect from this and can only take place in conjunction with FIG. 13.

Figure 13:
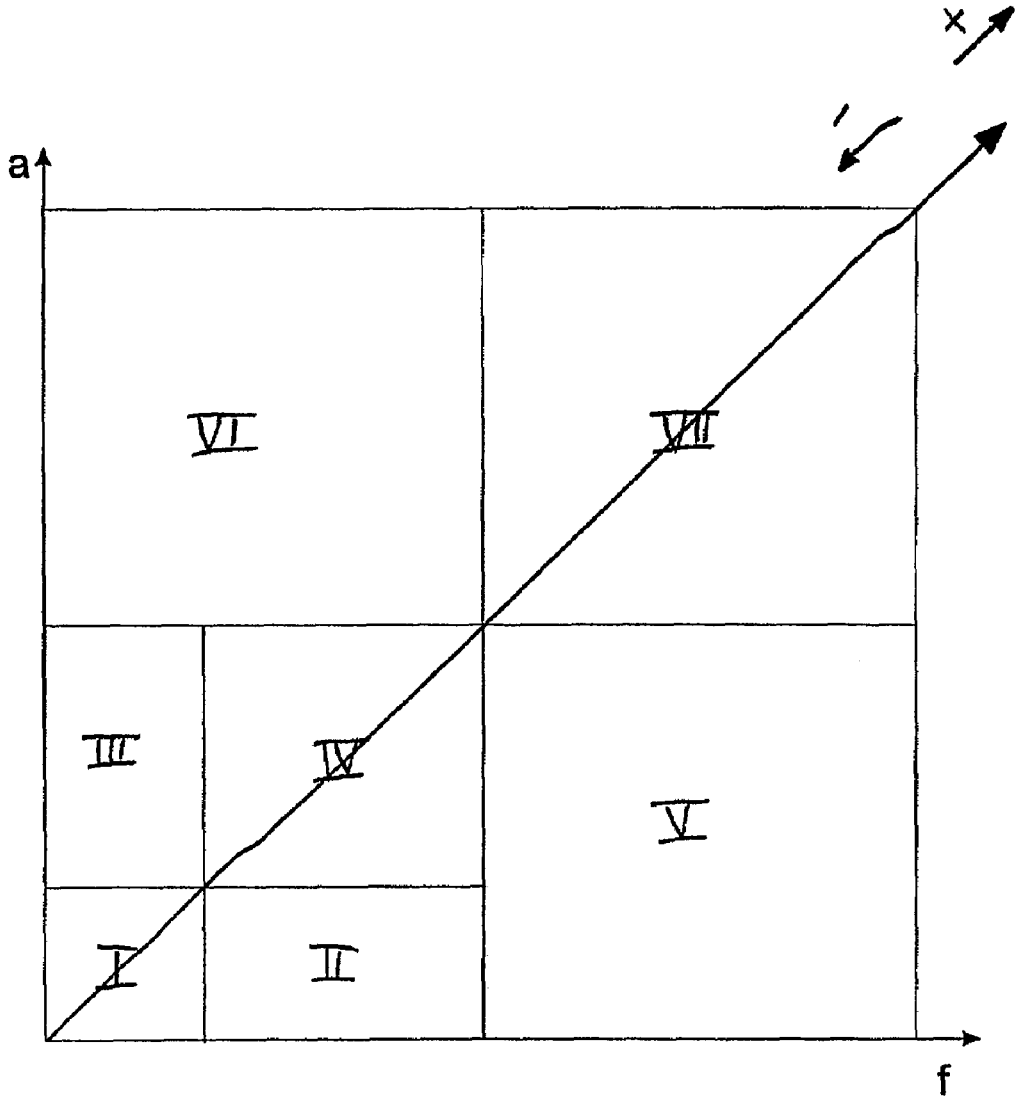
FIG. 13 illustrates a separation between attenuation and frequency of oscillation of the signal at the receiver device corresponding to FIG. 10.

This will be explained hereinafter relative to FIG. 13, which shows the signal behaviour for different states corresponding to the different sequences during the cooking process. In field I and at the start of the cooking process in FIG. 10 attenuation a and oscillation f are low, because little is taking place in the vicinity of the exhaust hood or over a hotplate 14 according to FIG. 2. In field II attenuation is low, but oscillation is at an average level, so that some heat is present but little vapour is evolved. This indicates the end of a cooking process. In field III attenuation is at an average level, but oscillation is low, which indicates the start of a cooking process. In field IV attenuation and oscillation are at an average level, so that it can be concluded that a normal cooking process is taking place and in particular only one hotplate is being operated.

In field V attenuation a is at a medium level, whilst oscillation f is significantly increased. This indicates medium vapour evolution at a very high heat level, i.e. a strong baking or roasting operation. In field VI once again oscillation is at a medium level, whereas attenuation significantly increases. This indicates a very strong cooking operation with considerable vapour evolution, but not excessive heat. Finally, in field VII attenuation and oscillation are high, which indicates a strong cooking and baking operation, e.g. using several hotplates, some for baking and some for cooking. Correspondingly from the pattern of FIG. 10 it is possible to detect the sequence of a cooking process with the start of heating or cooking, within the broken line area normal cooking and subsequently to the right of the broken line area the dying away of the cooking process with residual heat. This can be detected by the control means in the control method for the exhaust hood, so that its power is so-to-speak automatically adapted.

Besides an automatic, adapted operation of the exhaust hood, in this way it is possible to detect the contamination of the filter and as a result a replacement or cleaning can take place in good time.

The invention claimed is:

1. A ventilation device comprising:

an exhaust hood comprising a drive unit for producing an air flow;

a transmitter device affixed to a first side of the exhaust hood generating a laser light beam directed to a second side of the exhaust hood, wherein said transmitter device comprises a first lens through which said laser light beam passes through resulting in an expanded laser beam;

a receiver device affixed to said second side, receiving said expanded laser light beam and generating an electrical signal in response, said receiver device comprising an optical sensor, wherein:

said expanded light beam forms a light spot comprising a plurality of maxima and minima light spots of varied sizes, at least one maxima light spot detected by said optical sensor, wherein said light spot is at least 5 millimetres wider than said optical sensor, and said plurality of maxima and minima light spots moving in response to changing ambient conditions of said air flow, thereby resulting in said electrical signal varying in amplitude and frequency over time; and a control device for receiving said electrical signal and controlling said drive unit, said control device comprising a processor for analyzing said electrical signal to determine a value determined by said number of maxima or minima light spots detected by said optical sensor over a time period, and controlling said drive unit in response to said value.

2. The ventilation device according to claim 1, wherein said control device is configured to control said drive unit by categorizing said electrical signal into one of a plurality of categories using an average value of frequency and attenuation over a defined time period.

3. The ventilation device according to claim 2, wherein said signal generated by said receiver device is generated in response to detecting radiation in a frequency range corresponding to said laser beam.

4. The ventilation device according to claim 2 wherein the speed of the drive unit is increased upon detection of an increased average of both of said attenuation and said frequency of said electrical signal.

5. The ventilation device according to claim 1, wherein said receiver device has a photoelectric sensor which comprises a photodiode.

6. The ventilation device according to claim 1 wherein said receiver device is equipped with filter means comprising a hollow duct, said filter means restricting the angular range in which the incident light is received by the optical sensor.

7. The ventilation device according to claim 1 wherein said drive unit can be activated, deactivated and controlled with respect to its power by said control device on the basis of said signal received from said receiver device wherein the power can be controlled in a stepless manner.

8. The ventilation device according to claim 1 wherein said control device is constructed for evaluating said electrical signal generated by said receiver device with respect to detecting the presence of air streaks in said air flow.

9. The ventilation device according to claim 1 wherein said control device is configured for controlling said drive unit depending on the change over time of the intensity or power of said electrical signal detected by said optical sensor.

10. The ventilation device according to claim 1 wherein said transmitter device comprises a multimode laser diode.

11. The ventilation device according to claim 1 wherein said transmitter device is constructed for emitting a said laser beam to form an irregular interference pattern comprising the plurality of maxima and minima light spots.

12. The ventilation device according to claim 11, wherein said transmitter device and said receiver device are constructed in such a way that in operation the optical sensor detects a subset of said plurality of maxima and minima light spots.

13. The ventilation device according to claim 11 wherein said transmitter device and said receiver device are constructed in such a way that the diameter of said light spot is at least 5 mm wider than the optical sensor of said receiver device.

14. The ventilation device according to claim 1 wherein said air stream further includes smoke particles.

15. The ventilation device according to claim 1, wherein at least one reflection device is provided, which reflects said laser beam emitted by the transmitter device to the receiver device.

16. The ventilation device according to claim 15, wherein there are at least two reflection devices, which are positioned and oriented so that said laser beam emanating from said transmitter device is reflected at least twice before being detected by said receiver device.

17. The ventilation device according to claim 16, wherein the two reflection devices face towards each other and are parallel to one another.

18. The ventilation device according to claim 1, wherein said first lens comprises a collimator lens.

19. The ventilation device according to claim 1, wherein the divergence of said laser beam can be adjusted by said control device.

20. The ventilation device according to claim 1, wherein at least two transmitter devices are provided for emitting laser beams with a different divergence.

* * * * *

UNITED STATES PATENT AND TRADEMARK OFFICE

CERTIFICATE OF CORRECTION

PATENT NO. : 7,442,119 B2
APPLICATION NO. : 11/736978
DATED : October 28, 2008
INVENTOR(S) : Fluhrer It is certified that error appears in the above-identified patent and that said Letters Patent is hereby corrected as shown below:

Column 14,

Line 4, Delete “a”.

Signed and Sealed this

Seventeenth Day of February, 2009

JOHN DOLL
*Acting Director of the United States Patent and Trademark Office*